US005660516A

United States Patent [19]

Artrip et al.

[11] Patent Number: 5,660,516

[45] Date of Patent: Aug. 26, 1997

[54] TURNING EASY OPEN CAN TOP TABS OVER AUTOMATICALLY WHEN THESE TABS ARE MADE UP-SIDE-DOWN

[76] Inventors: Donald Jason Artrip; Jerry Artrip, both of 164 Kaluna Ave., Bluff City, Tenn. 37618

[21] Appl. No.: 14,268

[22] Filed: May 12, 1993

[51] Int. Cl.[6] ..... B21D 51/44

[52] U.S. Cl. ..... 413/14; 413/16; 413/54; 413/66; 29/809; 29/818; 72/405.01; 72/424

[58] Field of Search ..... 413/14, 16, 54, 413/66; 72/405, 424, 426, 405.1; 29/525.1, 809, 818

[56] References Cited

U.S. PATENT DOCUMENTS 4,026,226 5/1977 Hahn ..... 413/14

4,568,230 2/1986 Brown ..... 413/14

4,932,822 6/1990 De Silva ..... 413/66

*Primary Examiner*—Jack W. Lavinder

[57] ABSTRACT

A press assembly for forming and attaching lift-tabs to can ends to form lift-tab can ends. A tab press is mounted on a frame for forming at least one lane of lift-tabs in a strip of metal stock material wherein the strip of metal stock material with the formed lift-tabs loosely attached thereto exits the tab press and is passed through a half twist to an inverted condition before entering a tab punching station. The tab punching station punches the formed tabs from the strip of metal stock material into a lane of formed tabs. A conveying moves the lane of formed tabs from the tab punching station to a conversion press wherein the conversion press attaches the lift-tabs to the can end.

1 Claim, 9 Drawing Sheets

TURNING EASY OPEN CAN TOP TABS OVER AUTOMATICALLY WHEN THESE TABS ARE MADE UP-SIDE-DOWN

BACKGROUND AND SUMMARY OF THE INVENTION

This invention relates generally to can tops for easy-opening cans and relates, more particularly, to the means and methods by which the can tops are produced.

Tabs for the can tops of easy-opening cans are made in commercially-available tab presses. One such press is the Minister P2-45 manufactured by the Minister Machine Company.

Tabs are commonly pressed in a die operation from a strip stock so that a formed tab has a smooth side and an opposite rough side. The smooth side of the tab is made in the bottom part of the die set. Thus, the rough side of the tab is made in the top part of the die set, and it is the rough side of the tab which faces downwardly in a completed can top.

The smooth side of a tab either cannot or has not been made by the upper portion of the tab die, and the invention with which this application is concerned proposes no change to that tab-forming process. As a strip of stock within which the tabs are formed are moved out of the tab press, the tabs are still attached in position in the strip, and the tabs are lying smooth side down and rough side up. (The smooth side of a tab is the side of the tab that faces upwardly when the top of a cola or beer can is viewed.)

The industry has long wanted a machine which combined the operation of making the tabs and attaching the tabs to the can tops. Such a machine would eliminate the labor costs involved in turning the tabs over following the formation of the tabs in the strip stock and the exit of the tabs from the tab die through chutes.

Heretofore, the tabs were punched out of the tab strip following the exit of the strip from the tab die, and the tabs moved in sequence out of the strip into the tab chutes, then to an individual who turned the tabs over. The tabs then traveled into fan end conversion press and were pressed on the can tops (or can ends).

The present invention eliminates the labor associated with the turning of the tabs over following the exit of the tabs from the tab die while not requiring that a single machine perform the combined operations of making the tab, turning the tab over and attaching the tab to the can top.

In particular, the present invention involves the step of permitting of the tab strip with the tabs attached thereto to move out of the tab press. Such can be effected in a Minister P-245 press (adapted to press tabs) by removing the punch and cutter at the front of the press. The camtrol box situated at the back of the press will roll the tab-formed strip along a designated path and if there is a need for another roller, a second Ferguson (i.e. commercially available) camtrol box can be installed. The tab-formed strip is then looped to turn the tabs over, and this looping occurs outside of the tab press. With the tabs turned over, the tab-formed strip can be passed underneath a tab punch and the tabs punched out into chutes. The punched tabs accumulate in chutes and are conveyed to the end conversion presses. Continuous operation can be had by adjusting the speeds of reciprocation of the tab press, tab punch and conversion presses so that the speeds are equal.

As an alternative to the looping of the strip, the tabs can be turned over by twisting the tab-formed strip after it has traveled out of the tab press.

The disclosure document with which this invention is concerned is no. 273384.

DETAILED DESCRIPTION OF AN ILLUSTRATIVE EMBODIMENT

Figure 1:
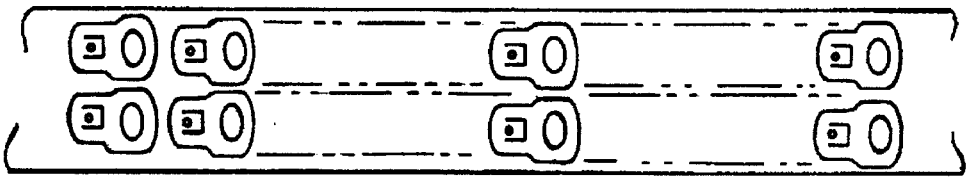
FIG. 1 is a view showing a tab-formed strip with two lanes of tabs.

Turning now to the drawings in greater detail, there is illustrated in FIG. 1 a tab-formed strip having two lanes of tabs. Although only two lanes are shown, a strip may include any number of lanes in accordance with this invention.

Figure 2:
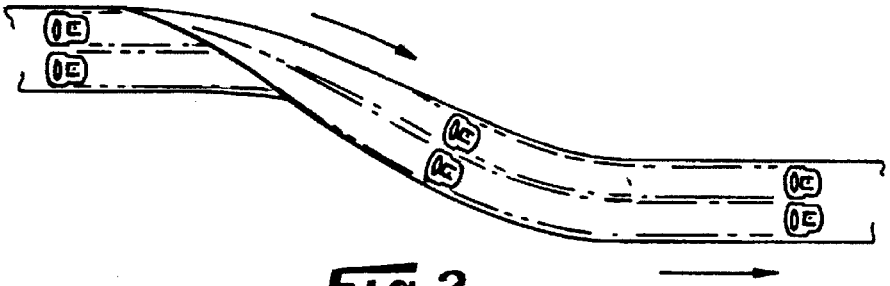
FIG. 2 is a view of a tab-formed strip shown in a twisted condition so that the tabs disposed at one end of the strip are turned over.
Figure 3:
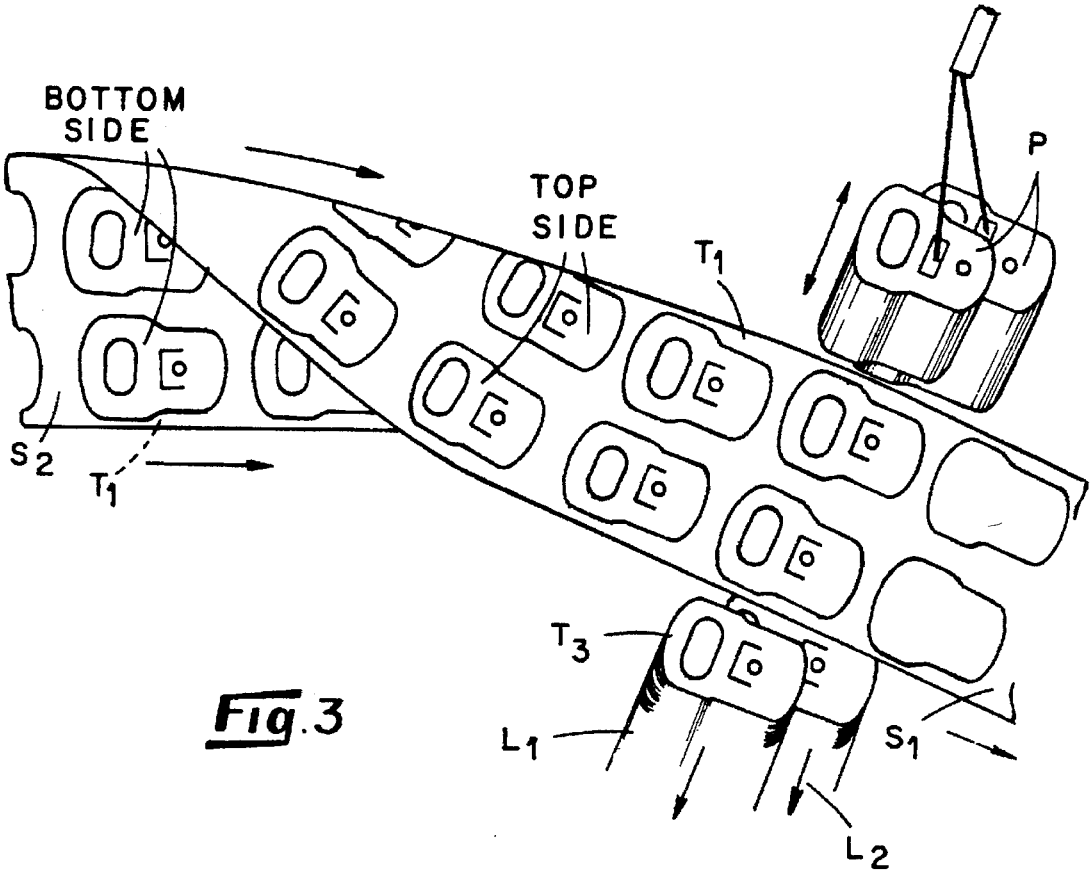
FIG. 3 is a view illustrating the tabs being turned over and punched out of a strip by a punch.

In FIG. 2, there is shown a tab, formed strip of aluminum stock shown arranged in a twisted condition (as the strip is moved through a half-twist) so that the tabs disposed at one end of the strip are turned over from those Shown disposed at the opposite end of the strip, and in FIG. 3, tabs are shown turned over and punched out of a strip $S_2$ by a punch P into lanes $L_1$ and $L_2$.

Figure 4:
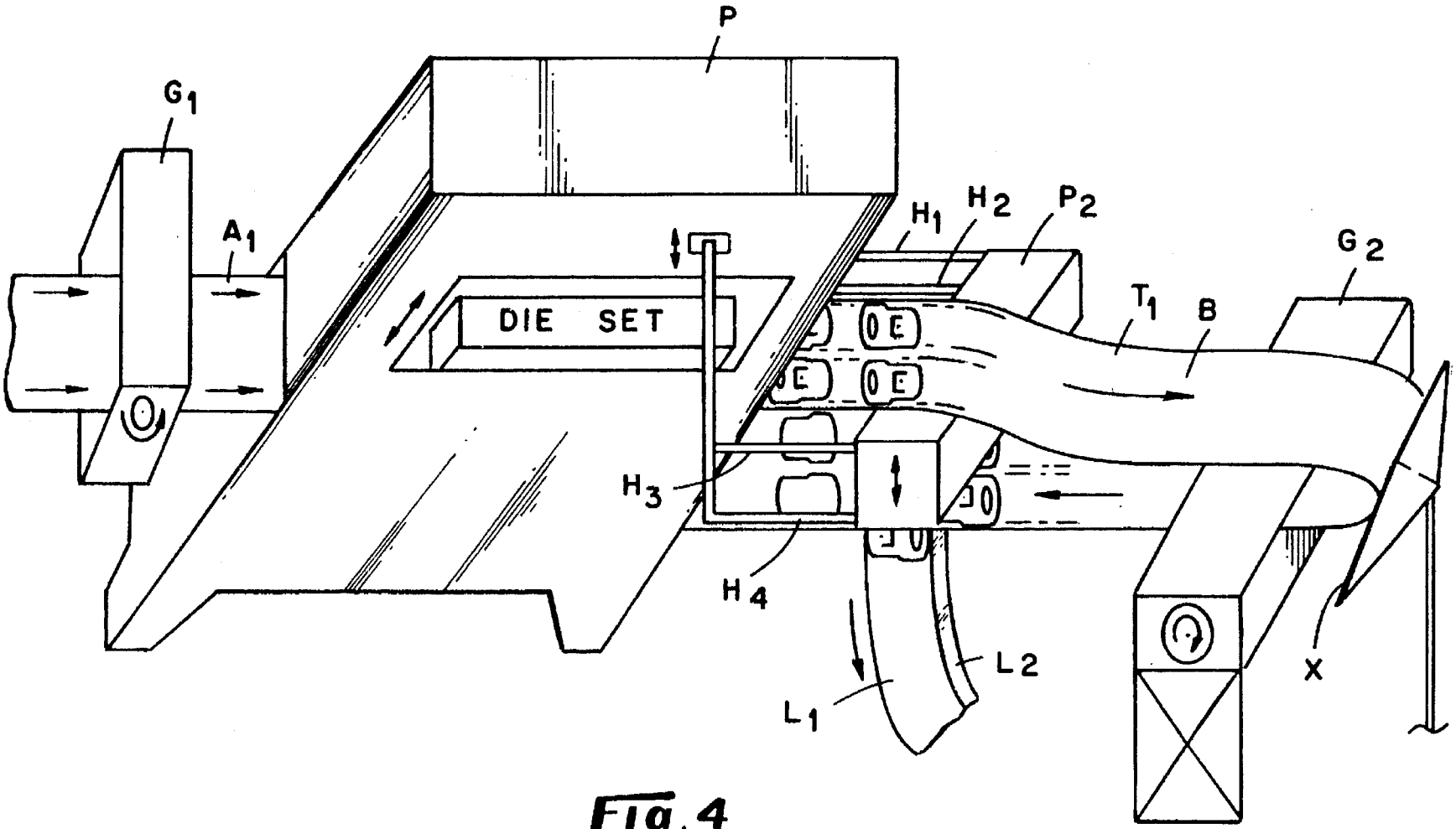
FIG. 4 is a view of one metal strip shown moving through a tab press and a tab strip shown exiting the tab press and being rolled along by a roller or camtrol box underneath a punch which, in turn punches the tabs into lanes.

In FIG. 4, a metal strip $A_1$ is shown moving through a tab press P, and a tab strip $T_1$ is shown exiting the tab press P and being rolled along by a roller or camtrol box $G_1$ and $G_2$ underneath a punch $P_2$. The punch $P_2$, in turn, punches the tabs into lanes $L_1$ and $L_2$. Connecting rods $H_1$, $H_2$, $H_3$ and $H_4$ connect punch $P_2$ to the reciprocating part of press P.

Figure 5:
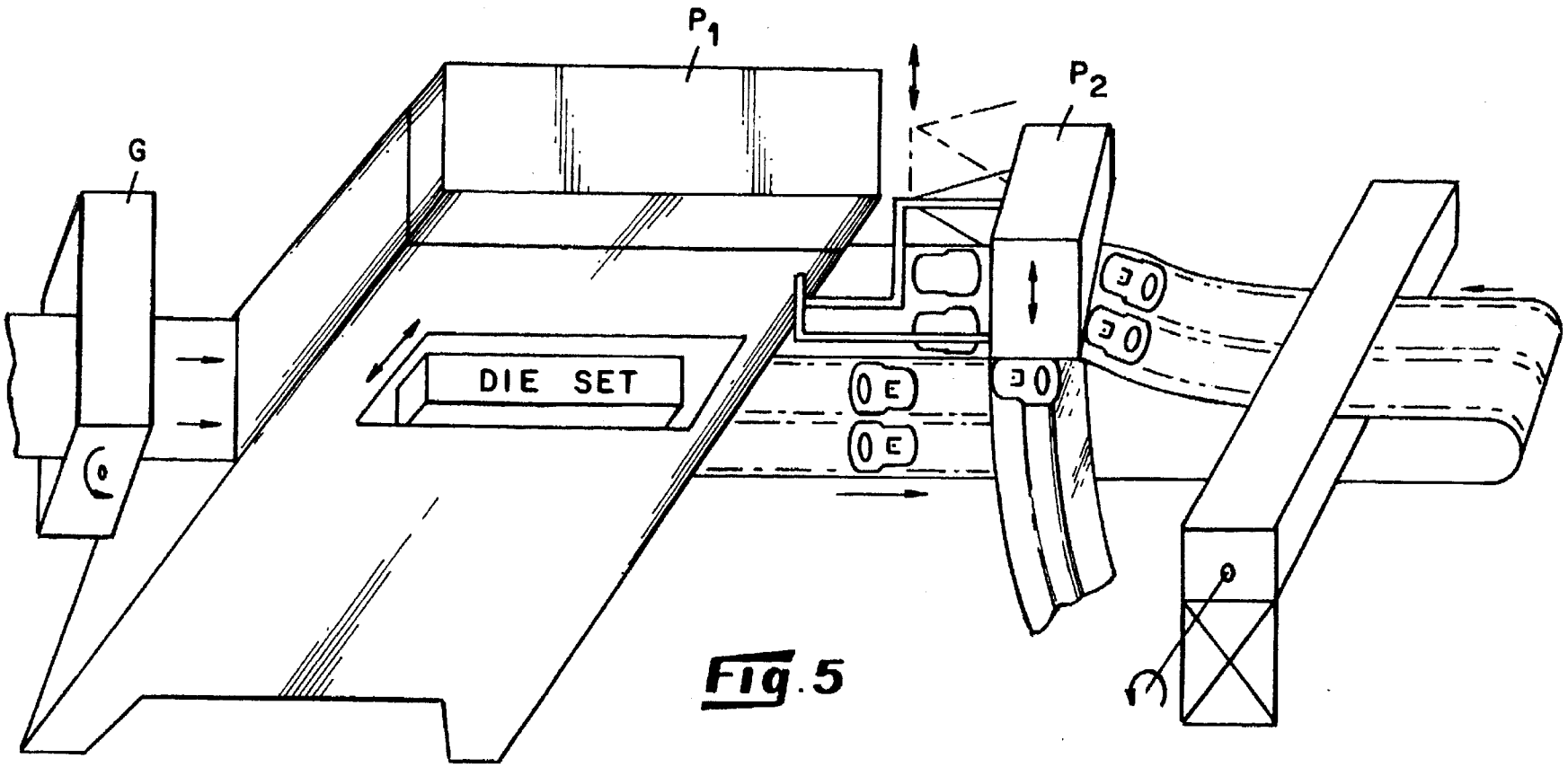
FIG. 5 is a view similar to that of FIG. 4 except that one punch is disposed above the exit level of another press.
Figure 6:
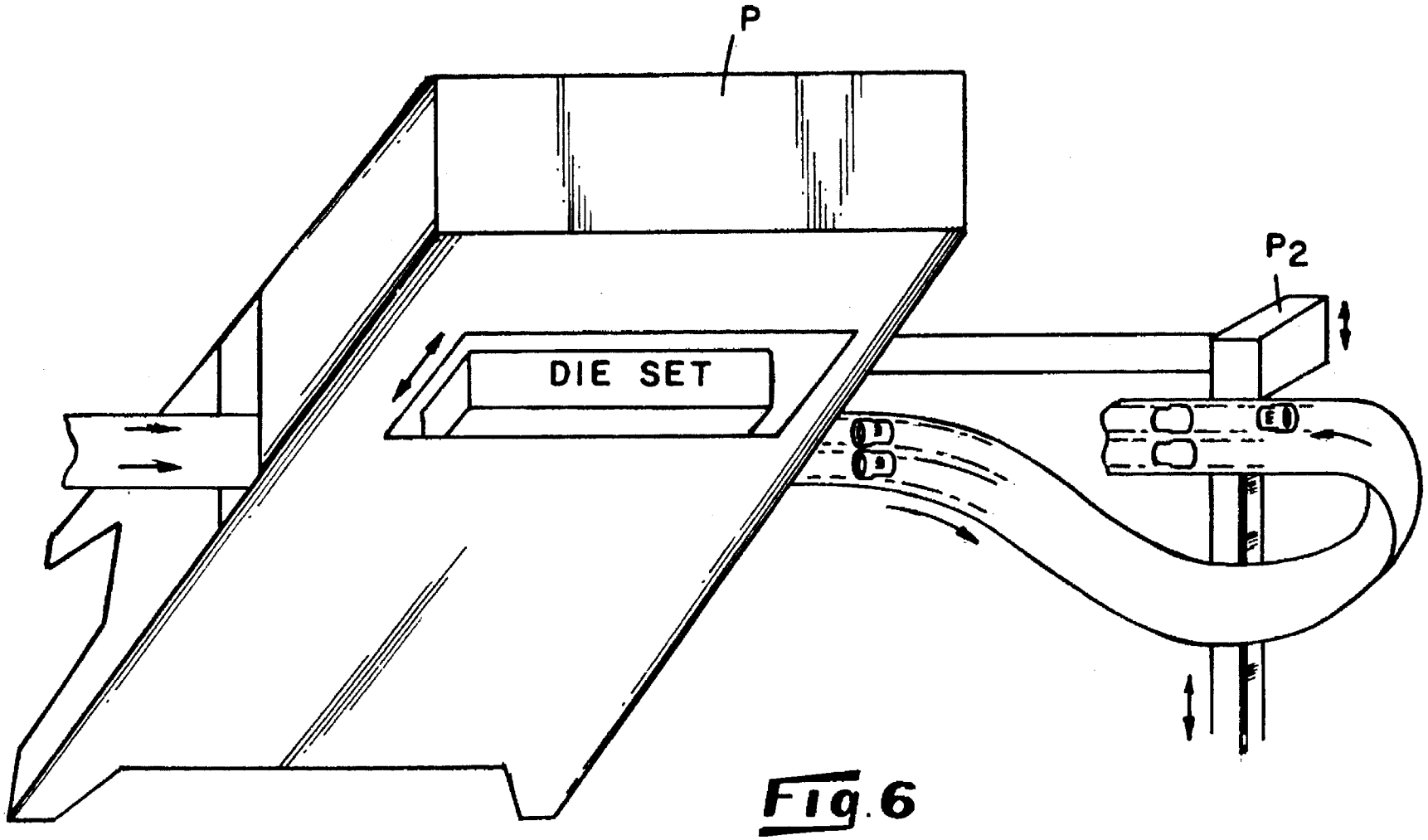
FIG. 6 is another view illustrating how one of the punches can attach to a reciprocating part of the tab press.

FIG. 5 is a view similar to that of FIG. 4 except that punch $P_2$ is disposed above the exit level of press $P_2$, and FIG. 6 is another view illustrating how punch $P_2$ can attach to the reciprocating part 2 of the tab press P.

Figure 7:
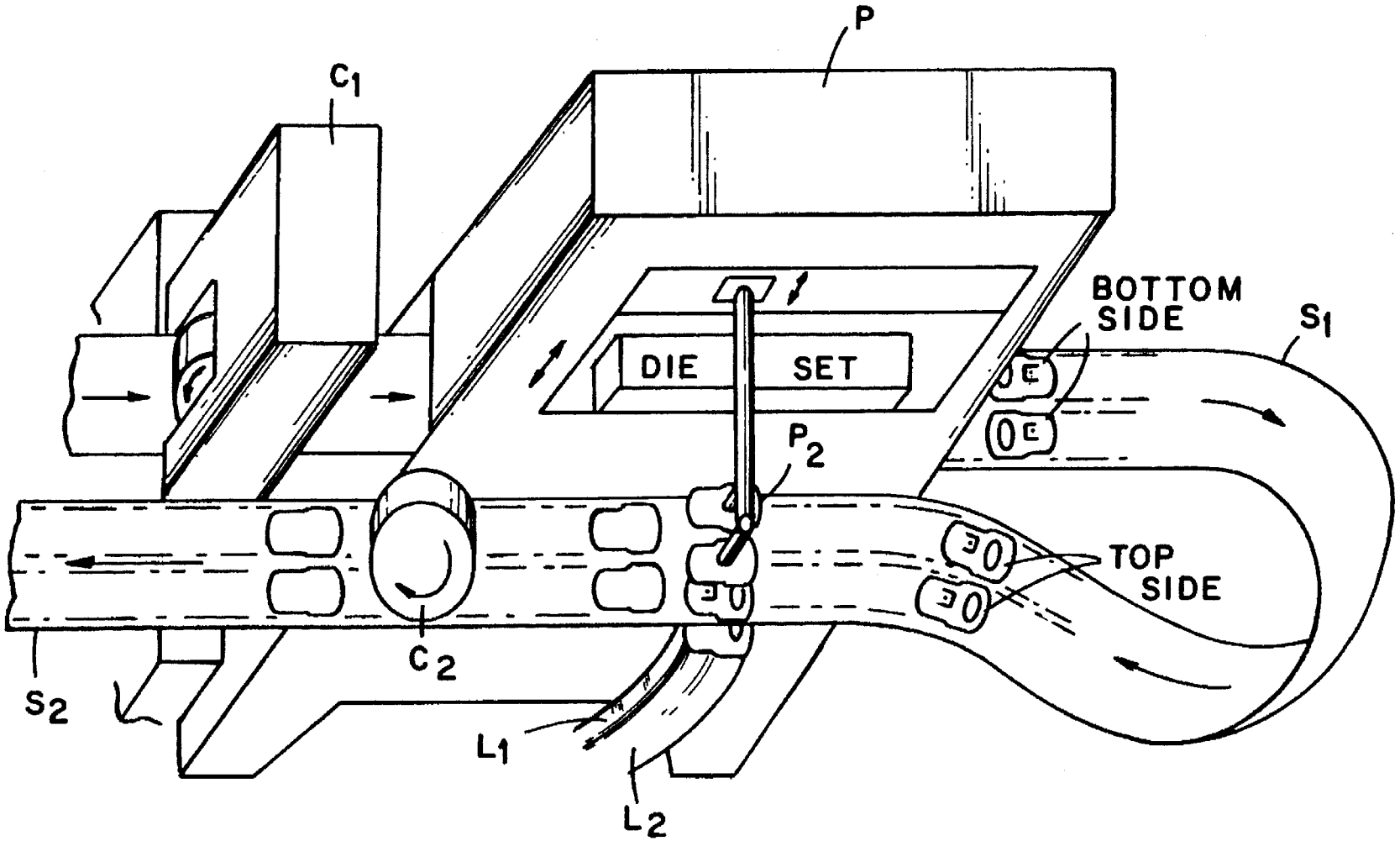
FIG. 7 is a view illustrating how a tab strip is looped and brought back adjacent one of the presses and directed beneath the other punch into chutes.
Figure 8:
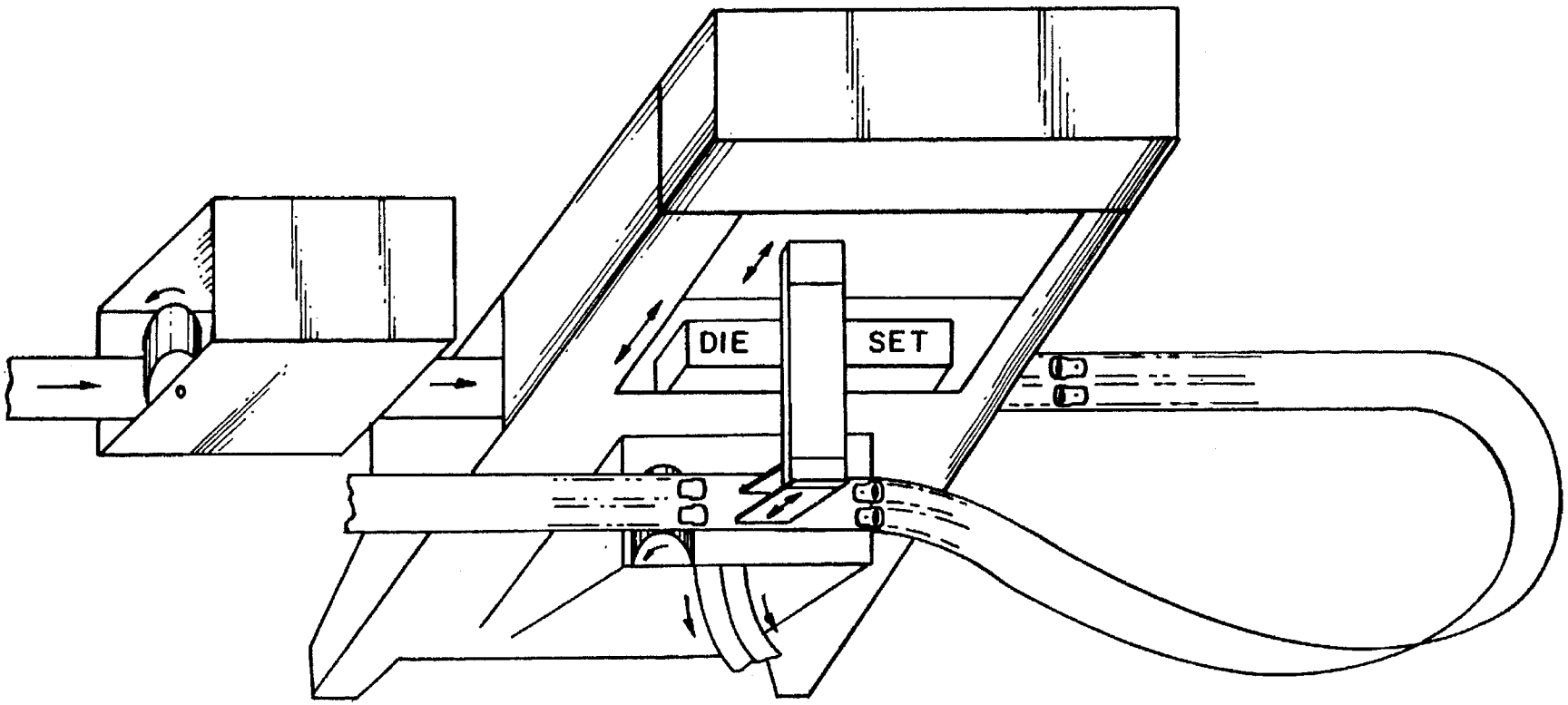
FIG. 8 is a view similar to that of FIG. 7 except that dummy tabs are shown.

In FIG. 7, a tab strip $S_1$ is shown in a looped condition (after having been moved along a path which simulates the arc of a half-circle) and brought back adjacent press $P_1$ and directed beneath punch $P_2$ into chutes $L_1$ and $L_2$. After tabs have been punched out of strip $S_1$, a skeleton $S_2$ remains. FIG. 7 also shows camtrol rollers $C_1$ and $C_2$, while FIG. 8 is a view similar to that of FIG. 7 except that dummy tabs are shown.

Figure 9:
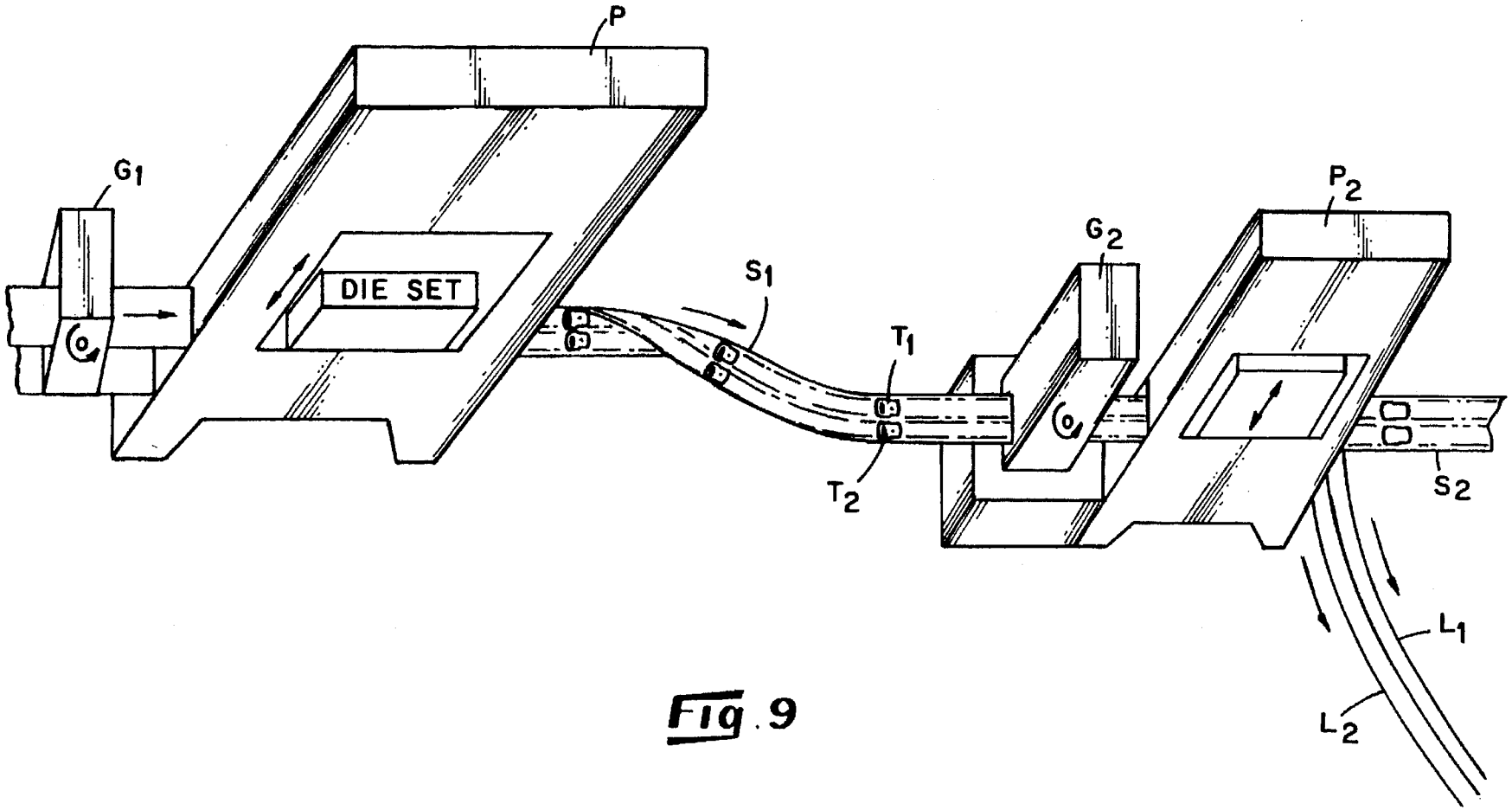
FIG. 9 is a view showing the tab-formed strip exiting the one press and being twisted over and then rolled by a roller through one of the presses.

FIG. 9 is a view showing the tab-formed strip exiting the press $P_1$ and being twisted over and then rolled by a roller $G_2$ through press $P_2$. Press $P_2$, shown with no tooling but a punch, is punching tabs out of strip $S_1$, and a strip skeleton $S_2$ remains.

Figure 10:
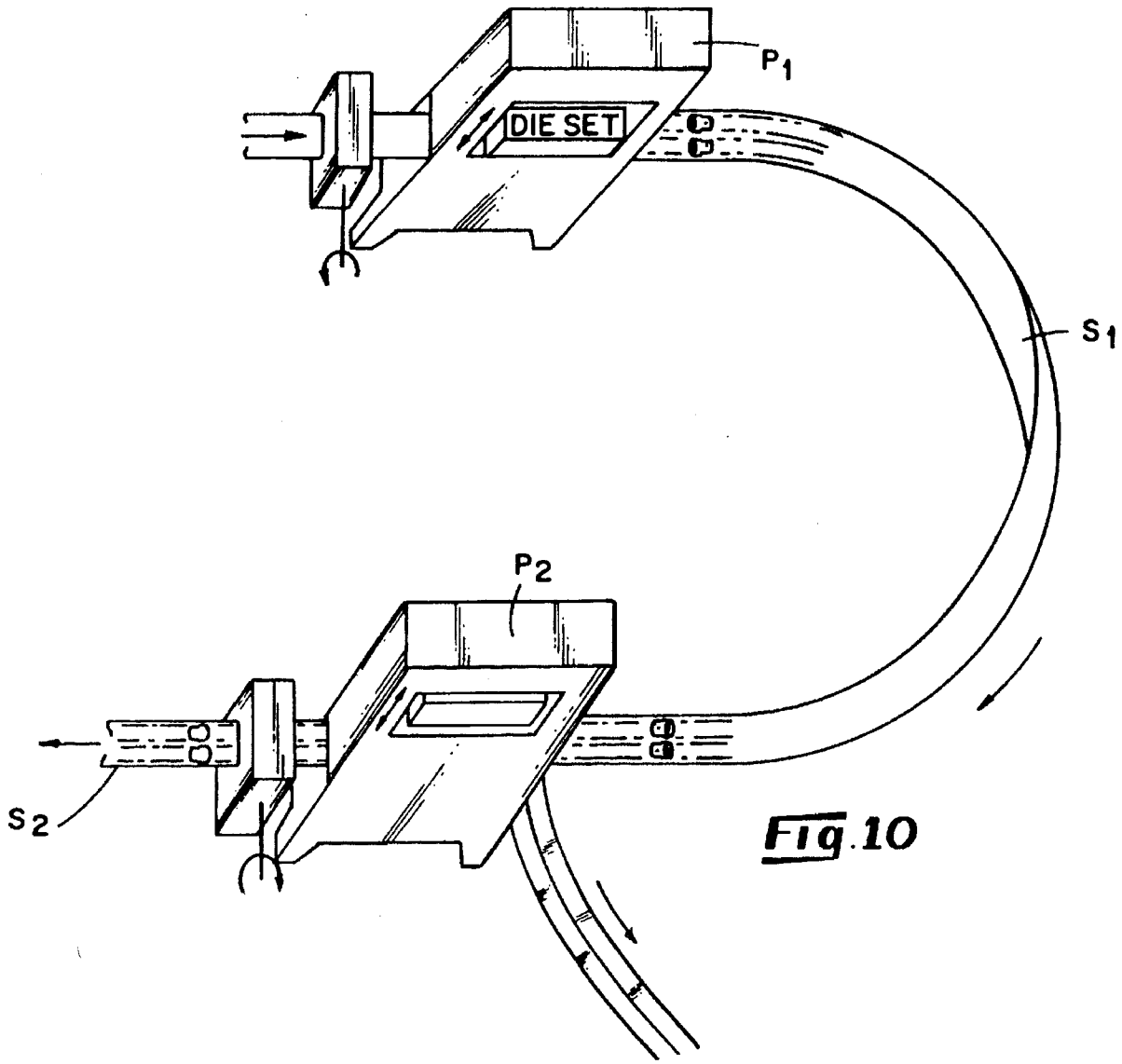
FIG. 10 is a view showing that tabs made in one press can be directed through another press in reverse of what is shown in FIG. 9, provided that the one press has no tab forming tooling in the die set.

In FIG. 10, there are shown tabs made in press $P_1$ and subsequently directed through press $P_1$ in reverse of what is shown in FIG. 9, provided that press $P_2$ has no tab-forming tooling in the die set.

Figure 11:
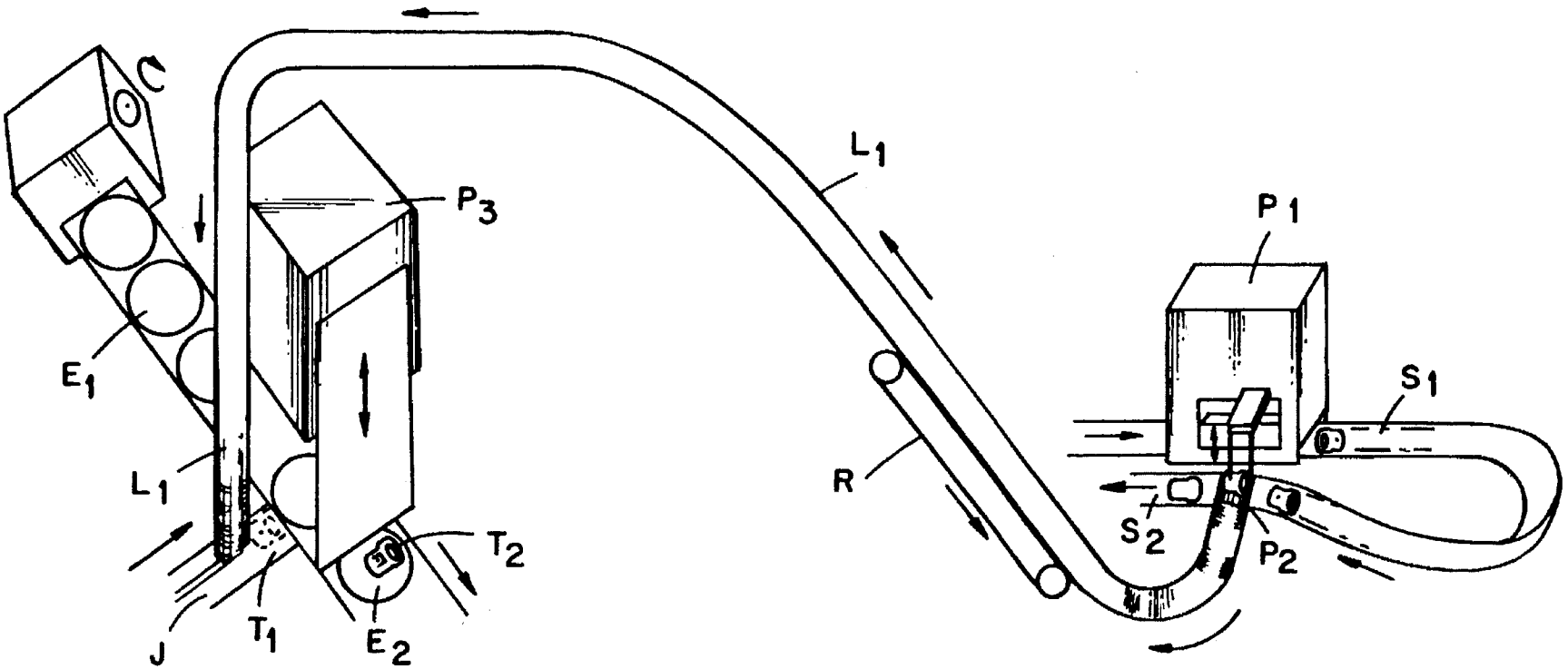
FIG. 11 is a composite drawing showing a tab-formed strip being formed by a press.

Lastly, there is shown in FIG. 11 a tab-formed strip $S_1$ being formed by a press $P_1$. In addition, Gabs are shown punched by press $P_2$ into lane $L_1$, and a conveyor R is shown directing the tabs which are arranged in lane $L_1$ into conversion press $P_3$ which has a tab ejector J. This tab ejector J feeds one tab into the conversion press $P_3$ for each reciprocation of the press $P_3$. This tab $T_1$ which comes out of the lane $L_1$ is placed by locating means (known in the art) into working relationship with a can end $E_1$, and then the tab $T_1$ is pressed onto the can end $E_1$ by the conversion press $P_3$. The can end $E_2$ is shown in FIG. 11 with a tab attached.

I claim:

1. A press assembly for forming and attaching lift-tabs to can ends to form lift-tab can ends, said press assembly comprising:

a tab press mounted on a frame for forming at least one lane of lift-tabs in a strip of metal stock material wherein the strip of metal stock material with the formed lift-tabs loosely attached thereto exits the tab press and is passed through a half twist to an inverted condition before entering a tab punching station;

a drive roller supported on the frame of the tab press for moving the strip of metal stock material through the tab press;

said tab punching station having a tab punch for punching the formed tabs from the strip of metal stock material into at least one lane of formed tabs;

a conveyor means for conveying the at least one lane of formed tabs from the tab punching station to a conversion press;

said conversion press having a tab ejector for feeding one tab at a time from the stack of tabs into the conversion press and a locating means for placing the tab into working relationship with a can end so that the conversion press attaches the tab onto the can end to form a lift-tab can end.

* * * * *

UNITED STATES PATENT AND TRADEMARK OFFICE

CERTIFICATE OF CORRECTION

PATENT NO. : 5,660,516
DATED : August 26, 1997
INVENTOR(S) : Donald Jason Artrip It is certified that error appears in the above-identified patent and that said Letters Patent is hereby corrected as shown below:

Title page, item [76], Inventor: should read--Donald Jason Artrip--.

Signed and Sealed this

Sixteenth Day of December, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,660,516
APPLICATION NO. : 08/014268
DATED : August 26, 1997
INVENTOR(S) : Donald Jason Artrip It is certified that error appears in the above-identified patent and that said Letters Patent is hereby corrected as shown below:

On the Title Page, Item [76] Inventors: Insert Donald Jason Artrip

Signed and Sealed this

Sixth Day of November, 2007

JON W. DUDAS
*Director of the United States Patent and Trademark Office*